United States Patent [19]

Neff et al.

[11] Patent Number: 4,856,560

[45] Date of Patent: Aug. 15, 1989

[54] VALVE BASE WITH INTEGRAL FLOW CONTROL VALVES AND COMMON EXHAUST PASSAGE

[76] Inventors: James A. Neff, 2584 Amberly Rd., Birmingham, Mich. 48084; Richard A. Fagerlie, 7291 Danbrook, West Bloomfield, Mich. 48322

[21] Appl. No.: 280,307

[22] Filed: Dec. 5, 1988

[51] Int. Cl.[4] ..... F10K 77/00

[52] U.S. Cl. ..... 137/884; 251/367

[58] Field of Search ..... 137/269, 271, 884; 251/367

[56] References Cited

U.S. PATENT DOCUMENTS

| | | | |
|---|---|---|---|
| 3,504,704 | 4/1970 | Beckett et al. | 137/625.64 |
| 3,513,876 | 5/1970 | Tarbox | 137/596 |
| 4,230,143 | 10/1980 | Dettmann et al. | 137/270 |
| 4,377,183 | 3/1983 | Johansson et al. | 137/606 |
| 4,509,556 | 4/1985 | Scanlon | 137/884 |
| 4,770,209 | 9/1988 | Neff | 137/884 |
| 4,770,210 | 9/1988 | Neff et al. | 137/884 |

*Primary Examiner*—John Fox

*Attorney, Agent, or Firm*—Robert G. Mentag

[57] ABSTRACT

A four port, individual, valve base for a fluid pressure valve system which is provided with a pair of integral exhaust flow control valves mounted in one end of the valve base, which meter the exhaust from a pair of exhaust inlet ports formed in the top surface of the valve base into a common exhaust passage, which communicates with a single exhaust outlet port formed in the front surface of the valve base. An electrical junction box is formed in the other end of the valve base.

3 Claims, 3 Drawing Sheets

VALVE BASE WITH INTEGRAL FLOW CONTROL VALVES AND COMMON EXHAUST PASSAGE

BACKGROUND OF THE INVENTION

1. Technical Field

The field of art to which this invention pertains may be generally located in the class of devices relating to valves. Class 137, Fluid Handling, U.S. Patent Office Classification, appears to be the applicable general area of art to which the subject matter similar to this invention has been classified in the past.

2. Background Information

This invention relates to an individual, valve base for a solenoid operated, four-way directional control valve wherein one end of the valve base comprises an electrical junction box. Heretofore, in order to provide such a valve structure with an exhaust flow control function it has been necessary to employ a sandwich or interface plate mounted on the valve base, with the exhaust flow control valves mounted in said plate. A disadvantage of such a sandwich or interface plate, when used to provide an exhaust flow control function, is that such a plate addition enlarges the overall directional control valve structure, increases the cost and weight of the valve structure, and makes such a valve structure more complex.

It is a primary object of the present invention, to provide a novel, individual, valve base for a four-way directional control valve which overcomes the problems of increased cost, increased weight and enlarged valve structure, which are present when it is required to provide a flow control function with the use of a sandwich or interface plate in a pneumatic control system.

It is another object of the present invention to provide a novel, individual, valve base for a four-way directional control valve which is light in weight, compact in structure, and which is constructed and arranged with an electrical junction box in one end, and a pair of flow control valves operatively mounted in the other end which meter the exhaust flow through the base from a pair of exhaust inlet ports into a common exhaust passage, and thence out of the base through a single exhaust outlet port.

It is a further object of the present invention to provide a novel, individual, valve base for a four-way directional control valve which does not require a sandwich or interface plate in order to provide an exhaust flow control function.

It is still another object of the present invention, to provide a novel, individual, valve base for a four-way directional control valve which provides a combined low profile valve structure, yet which can be employed to provide an exhaust flow control function.

SUMMARY OF THE INVENTION

The aforegoing objects are accomplished by providing a four port, individual, valve base with integral flow controls, which is simple and compact in structure, economical to manufacture and adapted for use in a fluid pressure valve system. The valve base of the present invention has a substantial rectangular configuration, with top, bottom, front side, rear side and end surfaces. The valve base is provided with an inlet pressure port and one exhaust outlet port formed on one side thereof. A pair of cylinder ports are formed in another side of the valve base. All of the ports are connected by internal passages to vertical passages which open at the top surface of the valve base for communication with corresponding passages in a four-way directional control valve mounted on the valve base.

The valve base inlet pressure port communicates with an inlet pressure passage means in the valve base that terminates at the top surface of the valve base. The cylinder ports communicate with separate cylinder supply and return passages in the valve base that terminate at the top surface of the valve base, on opposite sides of the inlet pressure passage means. The exhaust outlet port communicates with a common exhaust passage in the valve base that communicates with a pair of exhaust passages in the valve base that terminate at the top surface of the valve base, on the outer sides of the cylinder supply and return passages. An electrical junction box is formed in one end of the valve, and a pair of flow control valves are operatively mounted in the opposite end of the valve base, for selective metering of the flow of fluid exhausting through the separate exhaust passages and into the common exhaust passage, and thence out of the exhaust outlet port.

DESCRIPTION OF THE PREFERRED EMBODIMENT

Figure 1:
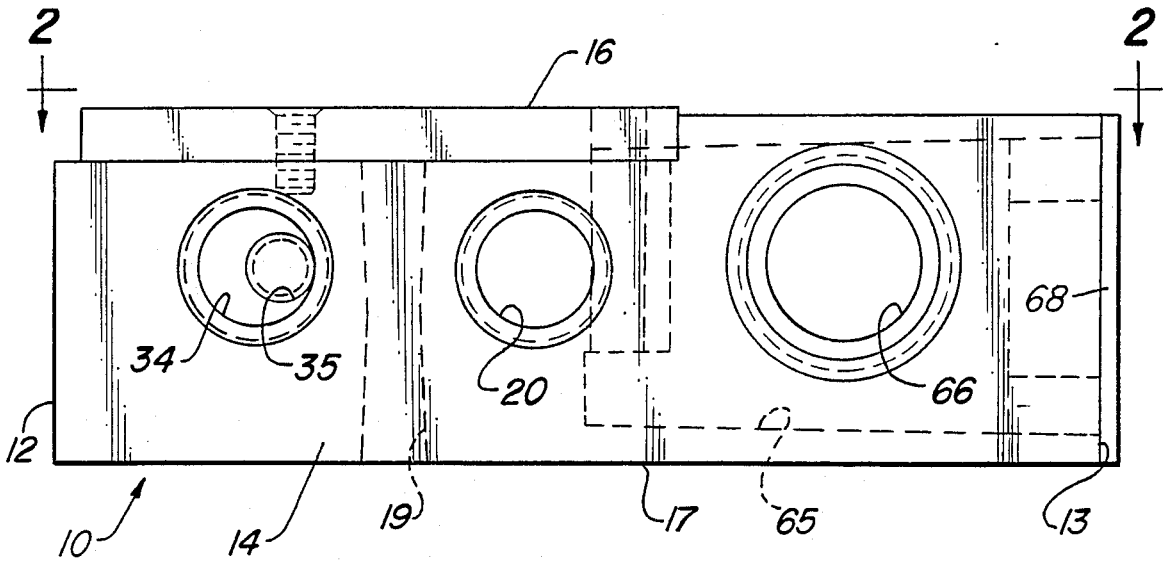
FIG. 1 is a front elevation view of a four port, individual, valve base, with integral exhaust flow control valve means, made in accordance with the principles of the present invention.

Referring now to the drawings and in particular to FIG. 1, the numeral 10 generally designates a four port individual, valve base made in accordance with the principles of the present invention and provided with integral flow control exhaust valve means. The valve base 10, is adapted to have operatively mounted thereon a conventional solenoid operated directional control valve.

Figure 2:
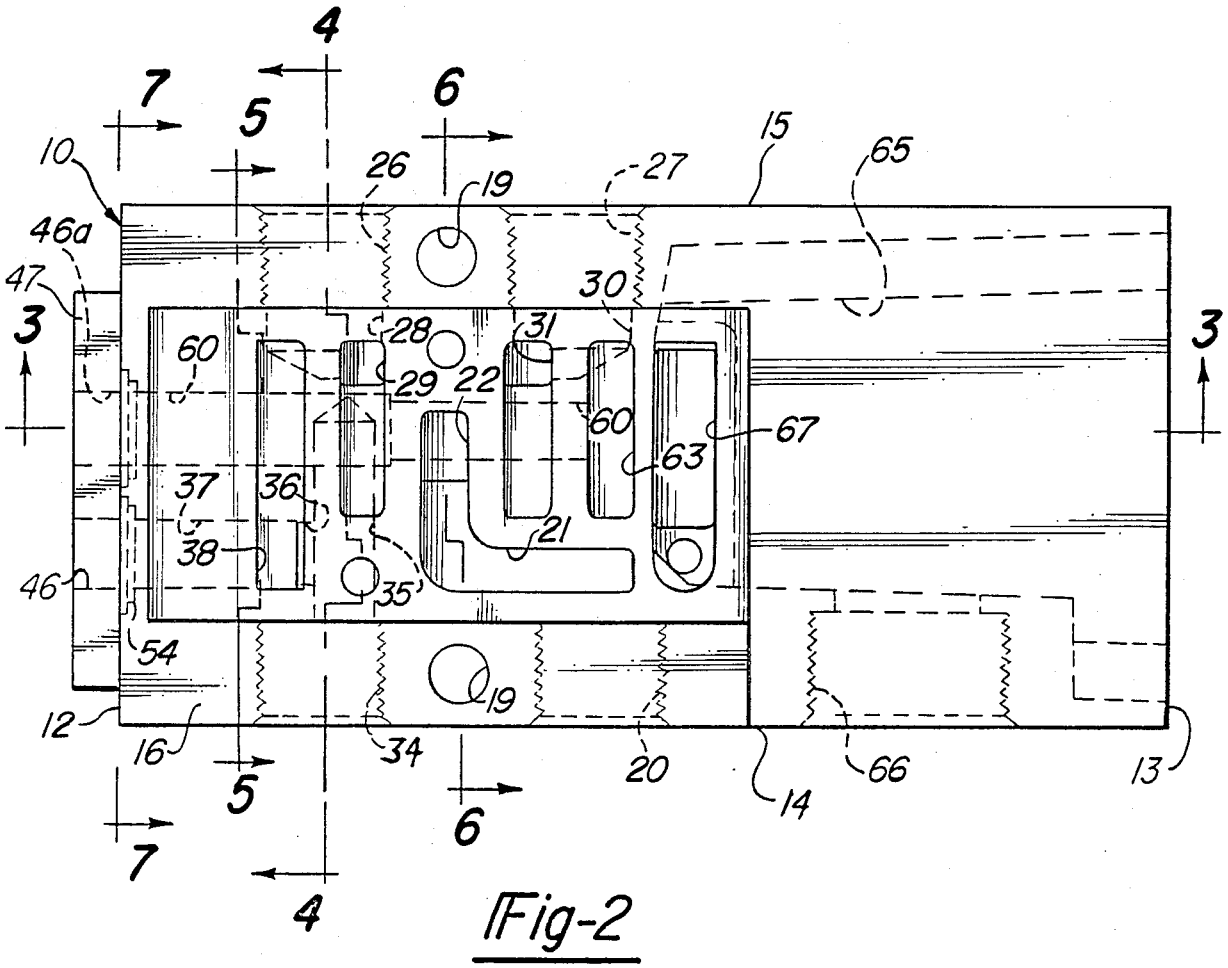
FIG. 2 is a top plan view of the individual, valve base illustrated in FIG. 1, taken along the line 2—2 thereof, with a part added, and looking in the direction of the arrows.

As shown in FIGS. 1 and 2, the valve base 10 is provided with left and right end surfaces 12 and 13, respectively, and front and rear side surfaces 14 and 15, respectively. As viewed in FIG. 1, the valve base 10 is provided with a top surface 16 and a bottom surface 17. The valve base 10 is provided with a pair of mounting holes 19 for the reception of mounting bolts, for mounting the valve base 10 in a required operative position.

Figure 3:
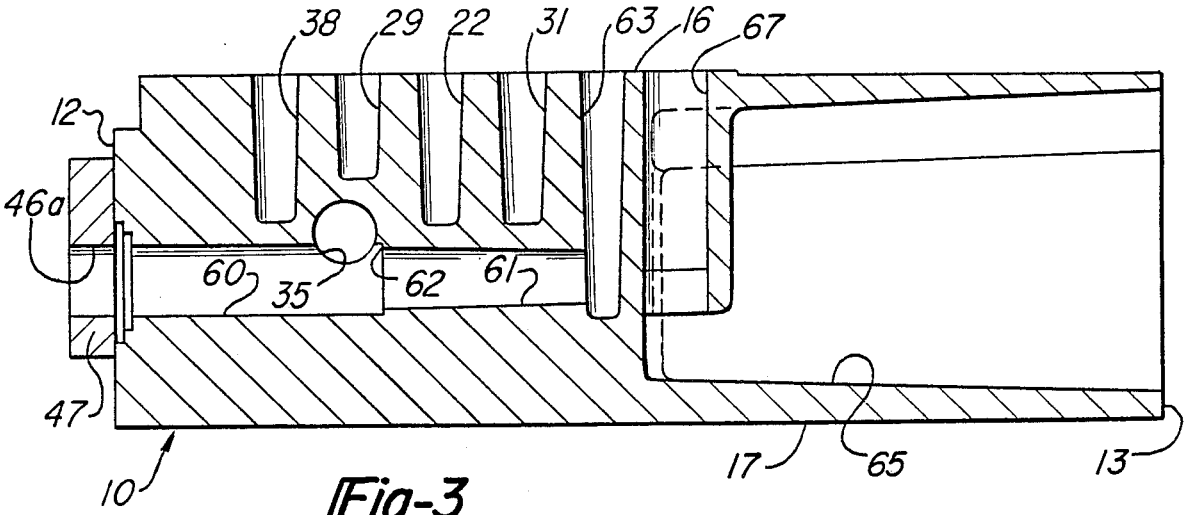
FIG. 3 is a longitudinal, elevation section view of the individual, valve base shown in FIG. 2, taken along the line 3—3 thereof, and looking in the direction of the arrows.
Figure 4:
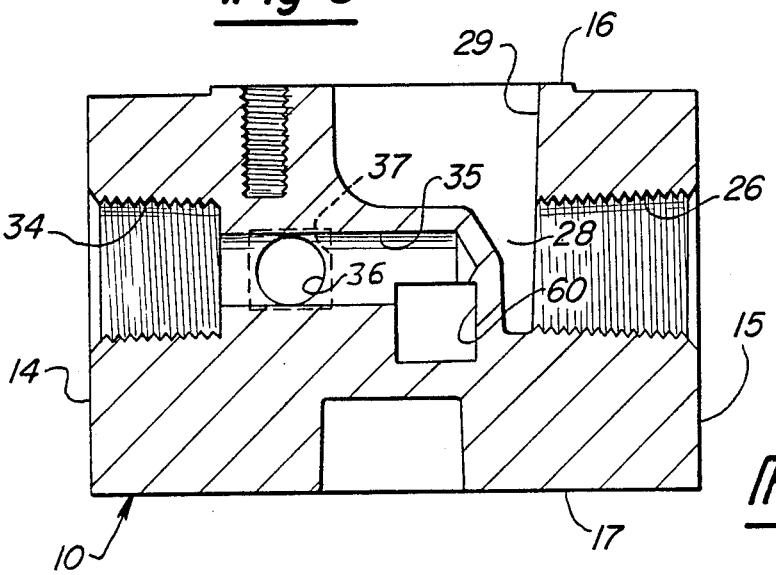
FIG. 4 is a transverse, elevation section view of the individual, valve base illustrated in FIG. 2, taken along the line 4—4 thereof, and looking in the direction of the arrows.
Figure 6:
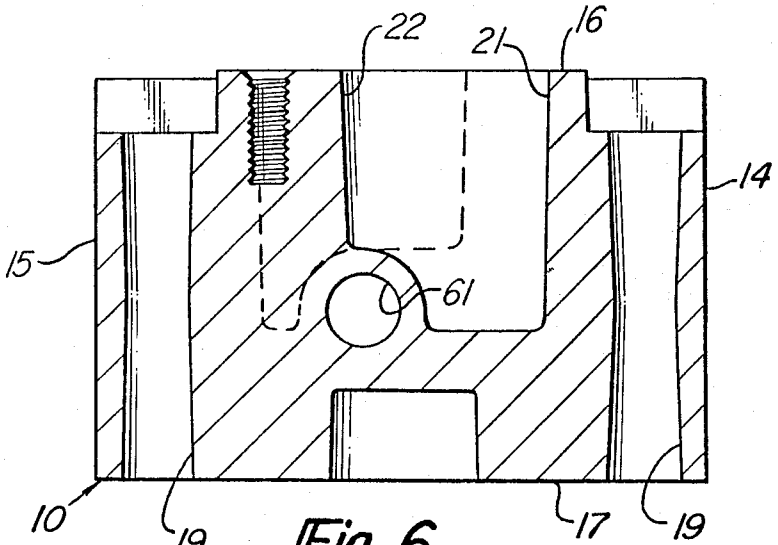
FIG. 6 is a transverse, elevation section view of the individual, valve base illustrated in FIG. 2, taken along the line 6—6 thereof, and looking in the direction of the arrows.

As best seen in FIG. 2, the valve base 10 is provided with an inlet pressure port 20 which is formed in the front side surface 14. The inlet pressure port 20 communicates through a horizontal, L-shaped, transverse, inlet pressure passage 21 with a vertical pressure passage 22 (FIG. 6) which terminates at the top surface 16 of the valve base 10. A first cylinder port 26 and a second cylinder port 27 are formed in the rear side surface 15 of the valve base 10, and they comprise fluid device supply and return ports. As best seen in FIG. 4, the first cylinder port 26 communicates through a horizontal, first transverse cylinder passage 28 with a vertical first cylinder passage 29 which terminates at the top surface 16 of the valve base 10. The second cylinder port 27 communicates through a horizontal second transverse cylinder passage 30 (FIG. 2) with a vertical second cylinder passage 31 which terminates at the top surface 16 of the valve base 10 (FIG. 3).

Figure 5:
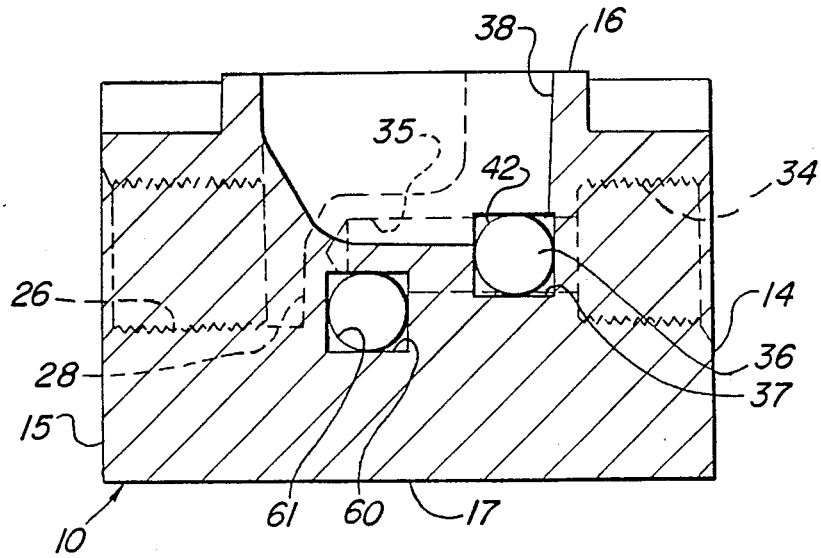
FIG. 5 is a transverse, elevation section view of the individual, valve base illustrated in FIG. 2, taken along the line 5—5 thereof, and looking in the direction of the arrows.
Figure 7:
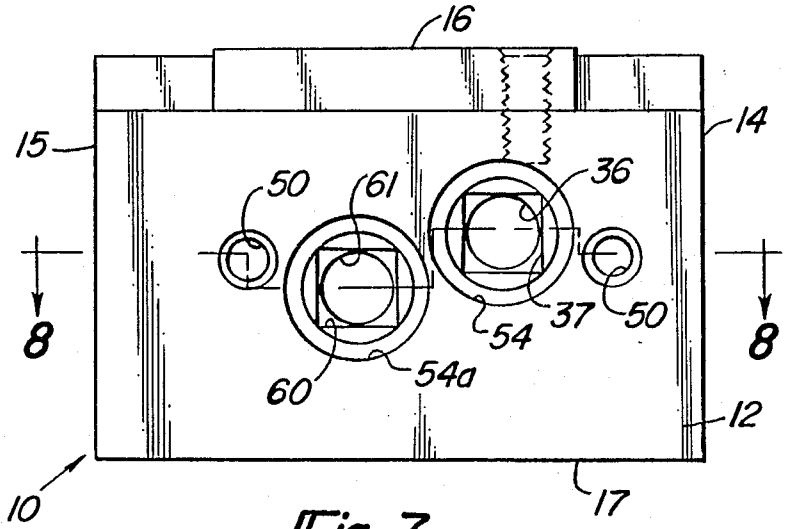
FIG. 7 is a left end, elevation view, with a part removed, of the individual, valve base illustrated in FIG. 2, taken along the line 7—7 thereof, and looking in the direction of the arrows.
Figure 9:
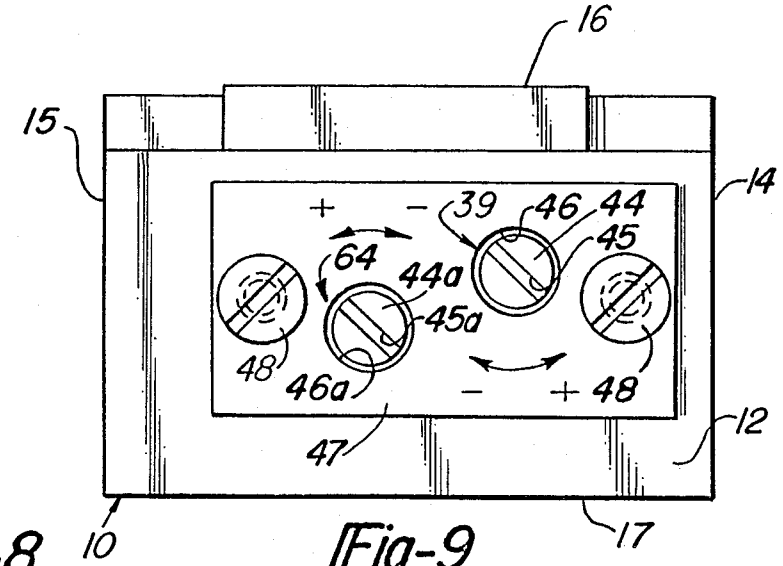
FIG. 9 is an elevation end view of the individual, valve base illustrated in FIG. 8, taken along the line 9—9 thereof, and looking in the direction of the arrows.
Figure 8:
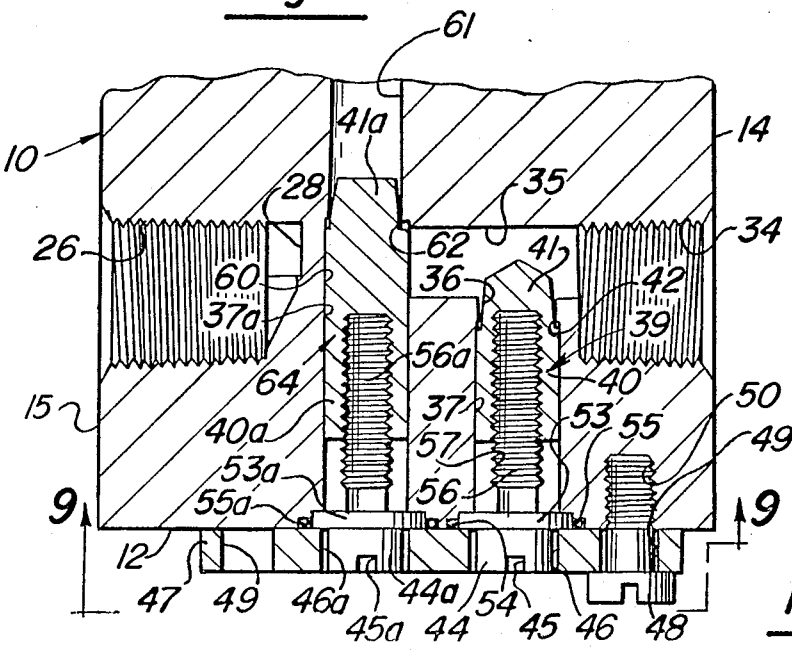
FIG. 8 is a fragmentary, horizontal section view of the individual, valve base illustrated in FIG. 7, taken along the line 8—8 thereof, and looking in the direction of the arrows.

As best seen in FIGS. 2 and 8, the valve base 10 is provided with an exhaust outlet port 34 which is connected to a horizontal, transverse, common outlet exhaust passage 35. As shown in FIG. 8, the common outlet exhaust passage 35 communicates through a longitudinal circular connecting passage 36 with the inner end of an aligned, longitudinally disposed flow control valve chamber 37, which is square in cross section, as shown in FIGS. 5 and 7. As shown in FIGS. 1 and 5, the longitudinal square flow control chamber 37 communicates with a vertical inlet exhaust passage 38 which extends upwardly and terminates at the top surface 16 of the valve base 10 to form an exhaust inlet port. The outer end of the flow control valve chamber 37 opens to the exterior of the valve body 10 at the left side surface 12.

As shown in FIG. 8, a non-rising type flow control valve, generally indicated by the numeral 39, is operatively mounted in the flow control chamber 37. The flow of exhaust fluid from the inlet exhaust passage 38 into the connecting passage 36, and thence out through the common outlet exhaust passage 35 and exhaust outlet port 34 is controlled by the flow control valve 39. The flow control valve 39 has a body 40 which is square in cross section shape along the central portion thereof. Integrally formed on the inner end of the flow control valve body 40 is a conically shaped valve 41, which is adapted to regulate the flow of exhaust fluid past a circular valve seat 42 that is formed at the junction point of the horizontal, longitudinal exhaust connecting passage 36 and the inner end of the flow control valve chamber 37. As shown in FIG. 8, the flow control valve 41 is in a closed position relative to the valve seat 42, but when it is moved rearwardly, or outwardly of the valve body 10, a flow of exhaust fluid is permitted past the valve seat 42 and into passages 35 and 36 and out through the outlet exhaust port 34.

The non-rising type flow control valve 39 has a cylindrical adjustment control head 44 that remains stationary, longitudinally, when it is rotated for adjusting the position of the valve 41. The cylindrical adjustment head 44 has a transverse slot 45 formed in the outer end face thereof, for rotating the adjustment head 44 by means of a suitable tool. The cylindrical adjustment head 44 is rotatably mounted in a bore 46 formed through a retainer plate 47 which is mounted on the left end of the valve body 10, as viewed in FIG. 2. As shown in FIG. 8, the retainer plate 47 is releasably secured to the left end 12 of the valve body 10 by a pair of suitable machine screws 48 which are mounted through suitable bores 49 in the retainer plate 47 and into threaded engagement with bores 50 in the valve body 10.

As shown in FIG. 8, the cylindrical adjustment head 44 has integrally formed on the inner end thereof, an enlarged diameter flange 53. The flange 53 is positioned in a stepped bore 54 which is larger than the bore 46 in the retainer plate 47. The flange 53 is retained in the bore 54 against axial or longitudinal movement by the retainer plate 47. A suitable O-ring seal 55 is mounted in the stepped bore 54 around the periphery of the flange 53, and it sealingly engages the outer periphery of the flange 53 and the inner surface of the retainer plate 47. Integrally attached to the inner side of the flange 53 is an elongated, threaded screw shaft 56. The screw shaft 56 is operatively mounted in a longitudinally extended, threaded bore 57, which is formed in the rear end of the valve body 40, and which extends longitudinally inward from the rear end of the valve body 40.

It will be seen, that when the flow control cylindrical adjustment head 44 is rotated in one direction or the other, it will remain in its longitudinal position while turning the threaded shaft 56. The turning of the threaded shaft 56 in the threaded bore 57 causes the valve body 40 to move forward or backward, in a straight line action, without any rotation due to the sliding effect of the square cross section of the flow control valve body 40 in the square cross section shaped flow control chamber 37.

As shown in FIGS. 3 and 8, a second flow control valve chamber 60 is formed in the valve base 10 in a position spaced apart from the first named flow control valve chamber 37, and parallel therewith. The flow control valve chamber 60 communicates with the common outlet exhaust passage 35, and the inner end thereof communicates with a longitudinally extended, horizontal inlet exhaust passage 61. A circular valve seat 62 is formed at the junction point of the inner end of the flow control valve chamber 60 and the outer end of the inlet exhaust passage 61. As shown in FIG. 3, the inner end of the inlet exhaust passage 61 communicates with a vertical inlet exhaust passage 63 which terminates at the upper end surface 16 of the valve base 10 to form a second inlet exhaust port.

As shown in FIG. 8, a second flow control valve, generally indicated by the numeral 64, is operatively mounted in the flow control valve chamber 60. The parts of the second flow control valve 64 are the same as the parts of the first described flow control valve 39, and the corresponding parts of the flow control valve 64 have been marked with the same reference numerals followed by the small letter "a". It will be seen that the second flow control valve 64 operates to provide a flow control function over the exhaust fluid exhausting into the inlet exhaust passage 63 and into the exhaust bore 61, and thence into the flow control valve chamber 60 and out through the common outlet exhaust passage 35 and the exhaust outlet port 34.

In use, both of the flow control valves 39 and 64 may be employed, or a single one of these flow control valves may be employed, for metering or controlling the flow of exhaust fluid entering the inlet exhaust ports 38 and 63 and exiting into the common outlet exhaust passage 35 and out through the exhaust outlet port 34.

As shown in FIGS. 1–3, the valve base 10 is provided with an integrally formed electrical junction box 65 in the right end thereof, as viewed in these Figures. An electrical conduit port 66 (FIGS. 1, 2) is provided in the front side of the valve base 10 and communicates with the electrical junction box 65 for access thereto. As shown in FIGS. 2 and 3, access to the electrical junction box 65 is also provided through an electrical plug-in port 67 formed through the upper surface 16 of the valve base 10. The electrical junction box 65 may be enclosed at the outer end thereof by a suitable closure plate 68 (FIG. 1).

It will be seen that the valve base 10 provides the advantage of a common exhaust passage leading to only one exhaust outlet port, whereby if the exhaust is to be expelled to the atmosphere then only one muffler is needed to keep the noise down. Also if the exhaust is to be piped away to another exit or location, then only one exhaust pipe is needed. The mounting of the flow control valves in the valve base 10 provides a compact structure, and also eliminates the need for any sandwich plate for holding flow control valves in a position between a valve base and a directional control valve. Furthermore, the provision of the flow control valves 39 and 64 integrally mounted in one end of the valve base 10, and the electrical junction box 65 at the other end, permits easy access to the flow control valves 39 and 64 mounted in the valve base 10 and yet provides space in the other end of the valve base 10 for an easy accessible electrical junction box 65 for housing the necessary electrical connection means required for operating a directional control valve mounted on the valve base 10. The bottom of the valve base 10 is normally a mounting surface and the two side surfaces are normally taken up with various ports. Accordingly, the valve base 10 provides a compact, valve base structure which incorporates the required mounting and port surfaces, and yet provides an easily accessible flow control valve means 39 and 64, and an easy accessible electrical junction box 65.

What is claimed is:

1. A four port, individual, valve base for a fluid pressure valve system, characterized by:

(a) said valve base having a substantial rectangular configuration with top, bottom, front side, rear side, and end surfaces;

(b) said valve base having an inlet pressure port formed in one of the valve base surfaces, which communicates with an inlet pressure passage means in the valve base that terminates at the top surface of the valve base;

(c) said valve base having a pair of cylinder ports formed in another of the valve surfaces, which communicate with separate cylinder supply and return passages in the valve base that terminate at the top surface of the valve base;

(d) said valve base having an exhaust outlet port formed in one of the valve surfaces, which communicates with a common outlet exhaust passage in the valve base;

(e) said valve base having a pair of internal inlet separate exhaust passage means, each of which has a first end communicating with the common exhaust outlet passage and a second end that terminates in an exhaust inlet port at the top surface of the valve base;

(f) said valve base having an electrical junction box formed in one end thereof; and, (g) a pair of flow control valves mounted in the opposite end of the valve base and operatively united with said pair of internal inlet separate exhaust passage means, for controlling the flow of fluid exhausting through said pair of internal inlet separate exhaust passage means and into said common outlet exhaust passage and out said exhaust outlet port.

2. A valve base for a fluid pressure valve system, as defined in claim 1, characterized by:

(a) each of said flow control valves being of a non-rising type flow control valve.

3. A valve base for a fluid pressure valve system, as defined in claim 2, characterized by:

(a) each of said flow control valves having a valve body which is square in cross section shape.

* * * * *